United States Patent [19]

Kidd et al.

[11] Patent Number: 4,991,641

[45] Date of Patent: Feb. 12, 1991

[54] METHOD OF AND APPARATUS FOR METAL CASTING

[75] Inventors: Thomas F. Kidd, Toledo, Ohio; Stephen A. Thompson, St. Bruno, Canada

[73] Assignee: Electrovert Ltd., Laprairie, Canada

[21] Appl. No.: 520,213

[22] Filed: May 7, 1990

[51] Int. Cl.[5] ..... B22D 17/04

[52] U.S. Cl. ..... 164/120; 164/113; 164/133; 164/316; 164/318

[58] Field of Search ..... 164/113, 120, 133, 316, 164/317, 318

[56] References Cited

U.S. PATENT DOCUMENTS

| | | | |
|---|---|---|---|
| 1,346,077 | 7/1920 | Carter | 164/316 X |
| 2,621,365 | 12/1952 | Deschamps | 164/316 X |
| 2,831,214 | 4/1958 | Eyles et al. . | |
| 3,209,419 | 10/1965 | Deguchi et al. . | |
| 3,495,652 | 2/1970 | Perrella . | |
| 3,548,921 | 12/1970 | Butterfield . | |
| 4,261,414 | 4/1981 | Frenette et al. . | |
| 4,471,829 | 9/1984 | Perrella et al. | 164/113 X |
| 4,676,296 | 6/1987 | Pascoe et al. . | |
| 4,690,198 | 9/1987 | Hardey et al. . | |
| 4,832,110 | 5/1989 | Perrella et al. | 164/316 |

FOREIGN PATENT DOCUMENTS

| | | | |
|---|---|---|---|
| 218037 | 10/1957 | Australia . | |
| 1483620 | 7/1971 | Fed. Rep. of Germany . | |
| 2128425 | 1/1973 | Fed. Rep. of Germany . | |
| 900842 | 7/1945 | France | 164/318 |
| 530249 | 12/1972 | Switzerland . | |
| 260637 | 5/1970 | U.S.S.R. | 164/316 |
| 1250476 | 10/1971 | United Kingdom . | |
| 1377628 | 12/1974 | United Kingdom . | |
| 1391785 | 4/1975 | United Kingdom . | |
| 2063127A | 6/1981 | United Kingdom . | |

*Primary Examiner*—Richard K. Seidel
*Assistant Examiner*—J. Reed Batten, Jr.
*Attorney, Agent, or Firm*—Darby & Darby

[57] ABSTRACT

An improved valve mechanism for casting metal alloys with low melting temperatures provides two valves in a single assembly inside an alloy tank. The valves being in the tank reduces the formation of oxides which can occur in air and tends to reduce leaks. The apparatus comprises a tank adapted to contain molten metal alloys, a cylinder in the tank having at its base a connection to an injection passageway which leads through the tank to a die located outside the tank. A piston reciprocates in the tank which allows molten metal alloy to be drawn into the cylinder and forced through the passageway to the die. A control system for the piston controls accurately the speed of the piston in the cylinder when the molten metal alloy is fed to the die.

15 Claims, 2 Drawing Sheets

METHOD OF AND APPARATUS FOR METAL CASTING

The present invention relates to a metal casting process to produce meltable metal cores for subsequent molding of components made of plastic materials and encapsulating components such as turbine blades so they may be held for machining and other finishing steps. More specifically, the present invention relates to an improved valve mechanism in an apparatus for producing a casting or encapsulation from a molten liquid.

Melt out metal cores of complex shapes are made for use as cores in subsequently molded plastic components. The cores are made of a metal alloy or other suitable material having a low melting temperature. They are placed in molds for making undercut hollow plastic components and then subsequently removed from the plastic components by melting the cores and leaving the undercut or hollow plastic components. The melting temperature of the cured metal alloy or other material is lower than that of the plastic component. In other embodiments metal alloys with low melting temperatures are used for encapsulating components such as turbine blades so they may be held for machining in other finishing steps. After use the metal from the cores or the encapsulations is remelted and reused. One example of an apparatus for casting metal alloys with low melting temperatures is disclosed in U.S. Pat. No. 4,676,296. In this patent, molten metal alloy is injected by a piston moving downwards in a cylinder places within a tank of molten metal alloy. The liquid metal alloy passes through a passageway from the bottom of the cylinder into a mold or die.

In our co-pending application Ser. No. 268,492 filed Nov. 8, 1988, and now U.S. Pat. No. 4,958,675, a metal casting process is disclosed wherein the injection cylinder is filled with molten metal alloy from the tank through a valve port in the injection passageway leading to the injection cylinder by raising the piston in the cylinder. The system discloses a block valve outside the tank in the passageway to the die.

We have now found that an improvement can be made by having two valves in the passageway from beneath the injection cylinder to the die, with the valves being in the metal alloy tank so that they are maintained at the same temperature as the molten liquid in the tank. Furthermore by having the two valves in the passageway and within the liquid alloy tank, enables a single assembly to be formed which can easily be installed and removed from the tank for cleaning and maintenance purposes.

Further, a valve outside the tank becomes dysfunctional over a period of time due to the presence of oxides from the alloy which gradually build up between the valve surfaces. The result is a valve which leaks metal. One advantage of placing the valve inside the tank, ensures that any metal which does escape the valve and leaks around the seats, stem and other parts, is contained within the tank. By removing the valve from an oxygen environment (i.e. air) the prime cause of valve leaks is eliminated. Thus when the valve is immersed in the alloy tank it is no longer in an oxygen environment, and the result is a longer lasting valve.

The present invention provides an apparatus for producing a casting or encapsulation from a molten liquid material comprising a tank adapted to contain the molten liquid, a cylinder located in the tank having at its base a connection to an injection passageway, leading through the tank to a die located outside the tank, a piston within the cylinder, a first valve in the passageway located in the tank having a first position wherein the passageway from the cylinder to the die is open, and a second position wherein the passageway to the die is closed, and a connection is open from the cylinder to a valve port openig in the tank, first valve operating means to transfer the first valve from one position to the other position, a second valve in the passageway, located in the tank after the first valve, to open and close the passageway from the first valve to the die, second valve operating means to open and close the second valve, and means to raise the piston in the cylinder with the first valve in the second position and the second valve closed, to fill the cylinder with molten liquid, and means to lower the piston in the cylinder with the first valve in the first position and the second valve open to inject molten liquid into the die.

In another embodiment there is provided a method of producing a casting or encapsulation from a molten liquid, utilizing an injection cylinder having an injection piston therein, the cylinder located in a tank containing molten liquid, and means to raise and lower the piston in the cylinder, an injection passageway extending from below the cylinder leading to a die external of the tank, the passageway having a first valve therein with a valve port opening to the tank and a second valve therein to open and close the passageway, the first valve and the second valve contained within the tank, the improvement comprising the steps of: operating the first valve to open the passageway from the cylinder and close the valve port opening, operating the second valve to open the passageway to the die, injecting molten liquid into the die by lowering the piston in the cylinder until the die is full, after predetermined delay, operating the second valve to close the passageway to the die, operating the first valve to close the passageway from the cylinder and open the valve port opening, and filling the cylinder with molten liquid from the tank through the valve port opening by raising the piston in the cylinder.

In the drawings which illustrate embodiments of the invention,

Figure 1:
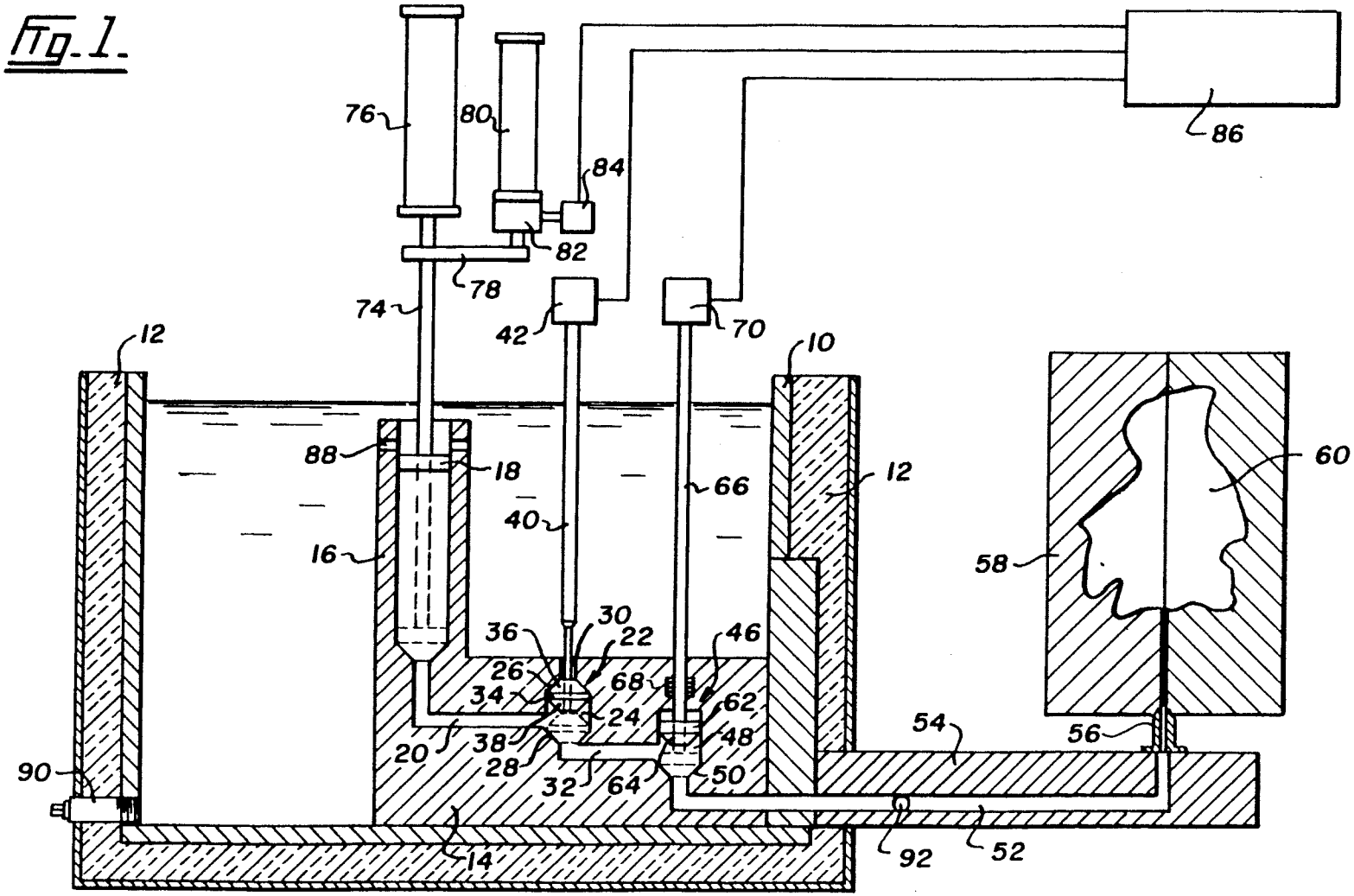
FIG. 1 is a sectional view through a tank showing a cylinder, valve arrangement and passageway to a die.

Referring now to FIG. 1, a liquid tank 10 with insulation 12 surrounding the tank, and a molten liquid material such as metal alloy and is kept hot in the tank so it is always in the molten state. Heaters for the tank are not shown herein but are generally of the external type that are located on the sides and bottom of the tank.

A cylinder and valve block assembly 14 is shown within the tank 10 sitting on the bottom. The valve block assembly 14, is detachable from the tank 10 so it can be removed to facilitate services. The valve block assembly 14 is located in the corner of the tank 10 so no metal alloy is present between the tank wall and the valve body 14. This avoids distortion and change which can otherwise occur due to the thermal expansion during meltdown. Within the assembly is an injection cylinder 16 having an injection piston 18 therein and below the cylinder is a first passageway 20 which extends to a first valve 22. The first valve 22 has a valve chamber 24 with a tapered top shoulder 26 and a bottom shoulder base 28. Above the tapered top shoulder 26 and in the center there is a valve port opening 30 which opens to the tank 10. The valve port opening 30 is located at an elevation below the bottom of the cylinder 16. Below the tapered bottom shoulder 28, and in the center thereof is an opening to a second passageway 32. The first valve 22 has a cylindrical member 34 which reciprocates within the chamber 24 and has a top valve seat 36 and a bottom valve seat 38. When the first valve 22 is in the first position, (open) the top valve seat 36 seals with the tapered top shoulder 26 in the valve chamber 24. The first passageway 20 is then open to convey molten liquid to the second passageway 32. When the valve 22 is in the second position, (closed) the bottom valve seat 38 seals with the tapered bottom shoulder 28 in the valve chamber 24. When in this position, the valve port opening 30 from the tank is open to the cylinder 16 and the second passageway 32 is closed.

The cylindrical member 34 is attached to a first valve stem 40 which in turn connects to an operator 42. The operator is shown as a solenoid however, pneumatic or hydraulic operators may also be provided.

The second passageway 32 extends to a second valve 46 which has a second valve chamber 48 with a tapered bottom shoulder 50 having at its center an exit to a passageway 52 leading through the wall of the tank 10 into an exterior block 54 and up through a nozzle 56 into a die 58. The die or mold 58 is preferably formed in two halves and is removal from the nozzle 56 for separation and removable of the casting 60 from the die 58.

The second valve 46 has a cylindrical member 62 with a bottom seat 64 to seal the valve on the tapered bottom shoulder 50 within the valve chamber 48. The cylindrical member 62 is attached to a second valve stem 66 which passes through seals 68 in the top of the block assembly 14 and then extends up above the level of molten liquid in the tank to an operator 70 preferably a solenoid or other suitable actuator such as a pneumatic or hydraulic operator, which permits the second valve 46 to be closed by lowering the second valve stem 66 so that the valve seat 64 on the cylindrical member 62 seals into the tapered bottom shoulder 50 within the valve chamber 48, thus closing the second valve 46. The second valve 46 is opened by raising the second valve stem 66 so the cylindrical member 62 allows molten liquid from the passageway 32 to pass to the final passageway 52 leading to the die 58.

The injection piston 18 is supported by a shaft 74 which moves up and down powered by a pneumatic cylinder 76. The cylinder is double acting and has adjacent to it and joined by a bridge 78 to a hydraulic cylinder 80 with a hydraulic valve 82 having a stepper motor 84 to open and close the hydraulic valve 82 and thus effect speed control of the injecting piston 18. This provides a variable speed dispersing stroke. The pneumatic cylinder 76 powers the piston and the speed of the piston is set by the stepper motor 84. A microprocessor 86 operates the pneumatic cylinder 76, controls the speed of the piston 18 in the cylinder 16 by the stepper motor 84, and operates the solenoid operator 42 for the first valve 22 and the solenoid operator 70 for the second valve 46 to ensure the correct sequence of steps occurs in the casting process.

Figure 2:
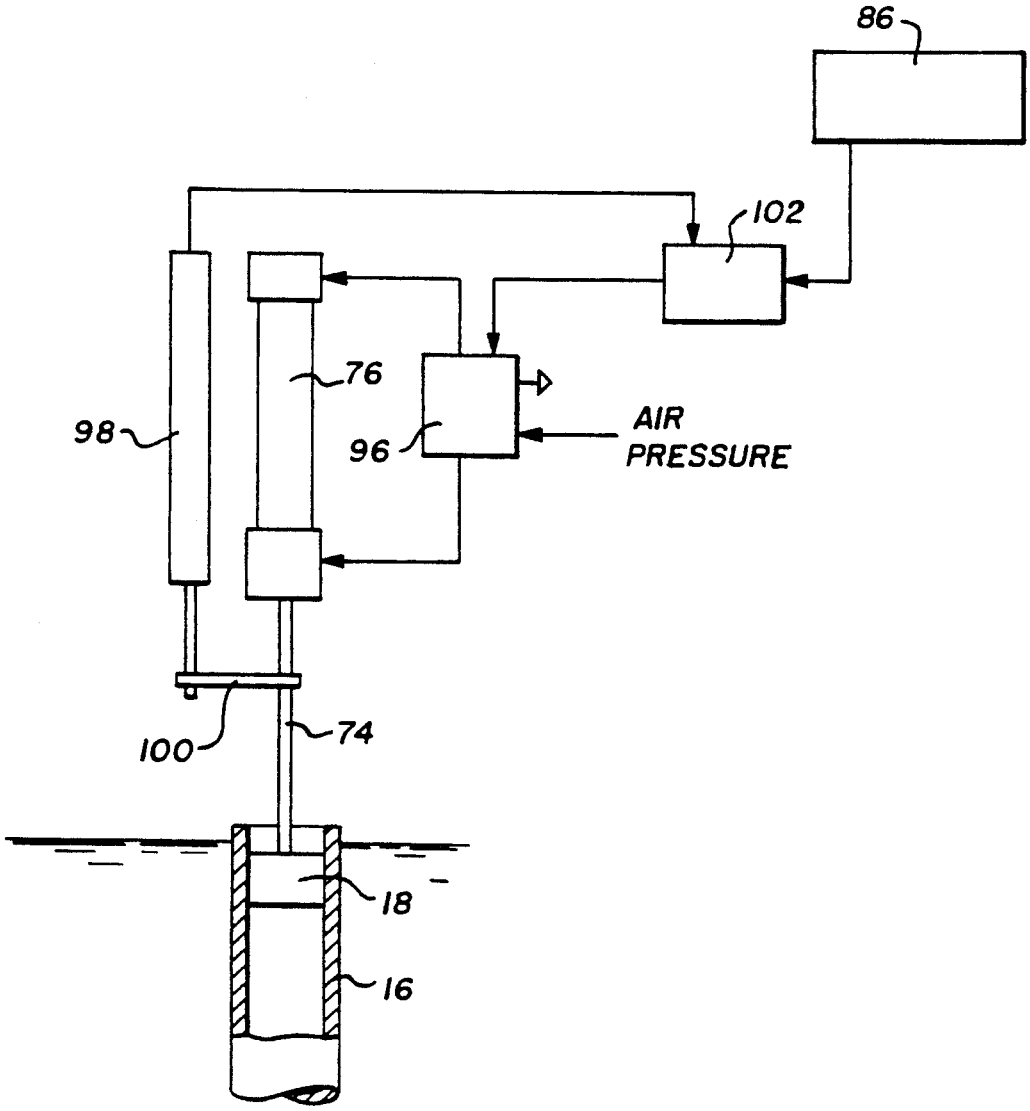
FIG. 2 is a schematic view of another speed control arrangement for the injection piston.

In another embodiment, the speed of the piston 18 in the injection cylinder 16 is controlled by the system illustrated in FIG. 2. In this system, the pneumatic cylinder 76 is controlled by a pneumatic servo valve 96. A displacement transducer 98 has a link 100 joined to the shaft 74 of the injection piston 18 to provide an accurate indication of position to a servo valve controller 102. The microprocessor 86 produces a programmable profile for movement of the piston 18, and this is controlled by the servo valve controller 102 and the servo valve 96 to provide the required speed of movement of the piston 18.

In the process of casting, the injection piston 18 is raised to the top of its stroke which as shown in FIG. 1 is positioned below drainage holes 88 whose use will be described hereafter. The first valve 22, referred to as the safety valve, is at the time of filling in the second position sealing the second passageway 32 but allowing the molten liquid to enter the cylinder through the valve port opening 30. The second valve 46, referred to as the dispense valve, is closed, that is to say the cylindrical member 62 is in the bottom position thus closing the passageway 52.

To begin the cycle, the first valve 22, or safety valve, moves from the second position to the first position with the first valve stem 40 moving upwards, so that the valve port opening 30 is closed and the second passageway 32 is open. Immediately after, the second valve 46 moves to the top position, completing the opening from the cylinder 16 to the nozzle 56. After a short delay, approximately half a second, the piston 18 is moved downwards in the cylinder 16 so that the molten liquid flows through the passageways 20, 32 and 52 into the die 58. The movement downward is controlled so that substantially no pressure builds up in the molten liquid while the die 58 is being filled. The time to fill the die 58 varies from approximately 3 to 30 seconds depending upon the die volume. After the mold is full, a small pressure is built up in the molten liquid by the injection piston 18 being forced down in the cylinder 16. The pressures are generally in the range of about 30 to 50 lbs. per square inch. Lower pressures are possible but higher pressures can in some circumstances result in porous castings. When the die is full and a small pressure has built up, it is generally maintained under pressure for a time in the order of about 1 to 10 seconds, dependent upon the size of the metal part.

After the die 58 is full, the second valve 46, or dispense valve, closes by moving downwards so that the cylindrical member 62 seals against the tapered bottom shoulder 50. After this has occurred, the first valve 22, or safety valve, moves from the first position to the second position thus closing the second passageway 32 and opening the valve port opening 30. After this has been completed the piston 18 moves slowly upwards filling the cylinder 16 by molten liquid entering the valve port opening 30 and the first passageway 20. When the piston 18 reaches its top position as shown in FIG. 1, the system is ready to commence its next cycle.

The flow rate of molten liquid into the die varies in the range of about 0.01 to 1 Kg per second depending on the size of the core or article to be molded. The injection time and the time delays between the sequence operation of the valve is all controlled by the micro processor 86. This micro processor 86 can be programmed for different articles being cast depending upon their size and complexity of shape. The program is so arranged that the speed of injection and the sequence of opening valves is arranged for a specific article being cast.

The tank 10 has a drain 90 with a plug or valve therein. Furthermore, a further drain 92 with a plug therein is provided at the lowest position of the passageway 52 outside the tank 10. If it is necessary to drain the system, then first of all the piston 18 is raised above the drainage holes 88, the first valve 22 is positioned in the first (open) position and the second valve 46 is opened. At the same time the drain 90 from the tank 10 is opened and the drain 92 from the passageway 52 is opened. Molten liquid drains out of the tank through the two drains. Because the piston 18 is raised above the drainage holes 88, air is permitted to enter the cylinder allowing the molten liquid to drain away either through the valve port opening 30 into the tank 10 or through the passageways 32 and 52 and out through the drain 92 in the passageway 52. By this method all of the liquid in the tank and valve system is drained.

Various changes may be made to the embodiments shown herein without departing from the scope of the present invention which is limited only by the following claims.

The embodiments of the present invention in which an exclusive property or privilege is claimed are defined as follows:

1. An apparatus for producing a casting from a molten metal comprising a tank adapted to contain the molten metal, a cylinder located in the tank having at its base a connection to an injection passageway leading through the tank to a die located outside the tank, a piston within the cylinder, a first valve in the passageway, located in the tank having a first position wherein the passageway from the cylinder to the die is open, and a second position wherein the passageway to the die is closed, and a connection is open from the cylinder to a valve port opening in the tank, first valve operating means to transfer the first valve from one position to the other position, a second valve in the passageway, located in the tank after the first valve, to open and close the passageway from the first valve to the die, second valve operating means to open and close the second valve, and means to raise the piston in the cylinder with the first valve in the second position and the second valve closed, to fill the cylinder with molten metal, and means to lower the piston in the cylinder with the first valve in the first position and the second valve open to inject molten metal into the die.

2. The apparatus for producing a casting according to claim 1 wherein the passageway and the valve port opening in the tank are below the cylinder.

3. The apparatus for producing a casting according to claim 1 wherein the first valve comprises a cylindrical member with a frustoconical valve seat at the top to close the valve port opening for the first position, and a frustoconical valve seat at the bottom to close the passageway to the die for the second position, the cylindrical member supported on a valve stem extending substantially vertically above the tank, and wherein the first valve operating means comprises means to reciprocate the valve stem so the cylindrical member is moved between the first position and the second position.

4. The apparatus for producing a casting according to claim 3 wherein the second valve comprises a second cylindrical member with a frustoconical valve seat at the base, to close the passageway to the die, the second cylindrical member supported on a second valve stem extending substantially vertically above the tank, and wherein the second valve operating means comprises means to reciprocate the second valve stem so the second cylindrical member is moved between an open position and a closed position.

5. The apparatus for producing a casting according to claim 1 wherein the tank has a drain means to drain molten metal from the tank, and including a drain connection to substantially the lowest portion of the passageway within the tank to permit the passageway to be drained of molten metal when the tank is drained.

6. The apparatus for producing a casting according to claim 1 wherein the cylinder, first valve, second valve and passageway from the cylinder are incorporated within a single assembly contained within the tank.

7. The apparatus according to claim 6 wherein the single assembly is detachable from the tank for servicing.

8. The apparatus according to claim 1 wherein the means to raise the piston in the cylinder and lower the piston in the cylinder comprises a double acting pneumatic servo valve to control the flow of air to and from the pneumatic cylinder and control means for the servo valve to ensure the raising and lowering of the piston follows a predetermined profile.

9. The apparatus according to claim 8 wherein the means to raise the piston in the cylinder and lower the piston in the cylinder includes a displacement transducer to provide a signal representative of the piston in the cylinder, and includes a servo valve controller for the servo valve.

10. A method of producing a casting from a molten metal utilizing an injection cylinder having an injection piston therein, the cylinder located in a tank containing molten metal and means to raise and lower the piston in the cylinder, an injection passageway leading to a die external of the tank, the passageway having a first valve therein with a valve port opening to the tank and a second valve therein to open and close the passageway, the first valve and the second valve contained within the tank, the method comprising the steps of:

operating the first valve to open the passageway from the cylinder and close the valve port opening, operating the second valve to open the passageway to the die, injecting molten metal into the die by lowering the piston in the cylinder until the die is full, after a predetermined time delay, operating the second valve to close the passageway to the die, operating the first valve to close the passageway from the cylinder and open the valve port opening, and filling the cylinder with molten metal from the tank through the valve port opening by raising the piston in the cylinder.

11. The method of producing a casting according to claim 10 wherein the injection of molten metal to the die is controlled, so there is substantially no pressure in the die during the injection step.

12. The method of producing a casting according to claim 11 wherein pressure is applied to the injection piston after the injection step to maintain molten metal under pressure during a cooling stage for a predetermined period of time.

13. The method of producing a casting according to claim 11 wherein the molten metal flow rate into the die is in the range of from about 0.01 to 1 Kg per second.

14. The method of producing a casting according to claim 10 wherein the injection step occurs in a time period of from about 3 to 30 seconds.

15. The method of producing a casting according to claim 10 wherein a time delay occurs between operating the first valve and the second valve for the injection step, and a further time delay occurs after operating the second valve and commencing lowering the piston in the cylinder to start injecting the molten metal.

* * * * *